US006178869B1

(12) United States Patent
Westman

(10) Patent No.: US 6,178,869 B1
(45) Date of Patent: Jan. 30, 2001

(54) PISTON MACHINE

(76) Inventor: Lars Gunnar Westman, Tallstigen 20, 915 32, Robertsfors (SE)

( * ) Notice: Under 35 U.S.C. 154(b), the term of this patent shall be extended for 0 days.

(21) Appl. No.: 09/316,649

(22) Filed: May 21, 1999

(51) Int. Cl.[7] ..... F01B 1/06
(52) U.S. Cl. ..... 92/12.1; 92/68; 91/491
(58) Field of Search ..... 92/12.1, 12.2, 92/13, 54, 56, 57, 58, 68, 71; 91/472, 491, 494, 499, 500; 418/61.1; 209/210, 215

(56) References Cited

U.S. PATENT DOCUMENTS

| | | | | |
|---|---|---|---|---|
| 1,499,480 | * | 7/1924 | Seeck | 74/650 |
| 1,988,407 | * | 1/1935 | Zierden | 417/462 |
| 2,431,817 | * | 12/1947 | Mann | 418/61.1 |
| 2,584,426 | * | 2/1952 | Crane | 418/22 |
| 2,593,457 | * | 4/1952 | Jastrzebski | 530/209 |
| 2,593,458 | * | 4/1952 | Jenness | 418/22 |
| 3,068,709 | * | 12/1962 | Petersen | 74/57 |
| 3,508,466 | * | 4/1970 | Tyler | 91/472 |
| 3,762,276 | * | 10/1973 | Gates | 91/197 |
| 3,816,039 | * | 6/1974 | Berry | 418/68 |

FOREIGN PATENT DOCUMENTS 7411695 9/1978 (SE) .

OTHER PUBLICATIONS

K. Becker INA; Main Advantages of this Motor that Operates by Subscribing an ARC Profile *Hanover Exhibit* (Apr. 25, 1993).

SAI Italy, New concept High Speed High Starting Torque Piston Hydraulic Motor (1993).

* cited by examiner

*Primary Examiner*—John E. Ryznic
(74) *Attorney, Agent, or Firm*—Fasth Law Offices; Rolf Fasth

(57) ABSTRACT

The axial piston machine may be used as a hydraulic pump or hydraulic motor. A rotor of the piston machine includes an outer part having a spherical inner surface and an inner part having a corresponding spherical outer surface. The inner part has a plurality of elongate grooves defined therein to seat pistons therein. A plurality of piston members protrude into the pistons. A sleeve member is disposed inside the inner part. The sleeve member has a plurality of openings defined therein that are connected to chambers in an alternating fashion. The sleeve member may be turned sideways to adjust the position of the inner part relative to the outer part to set the operational volume of the piston machine.

6 Claims, 3 Drawing Sheets

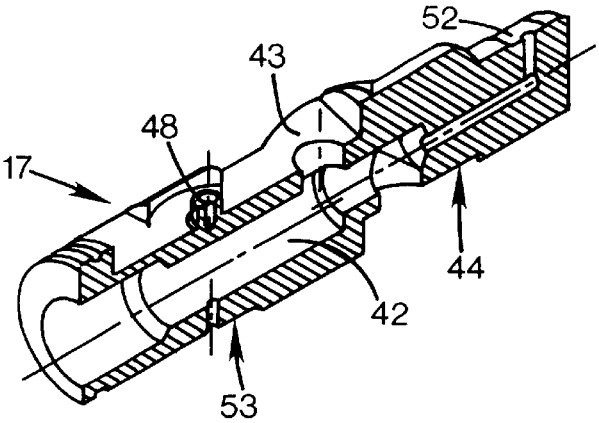
FIG. 7
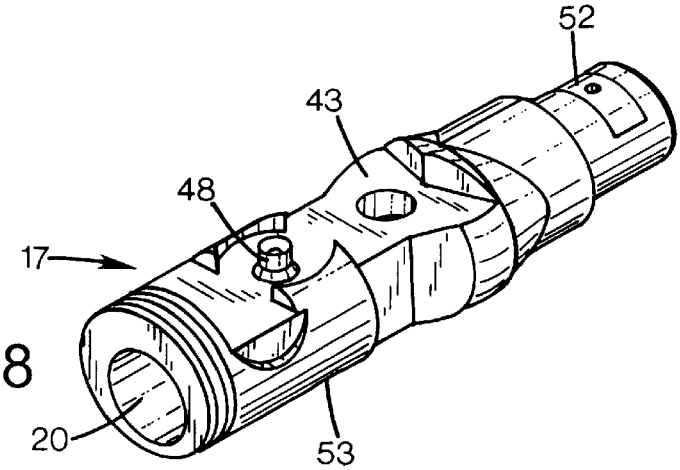
FIG. 8
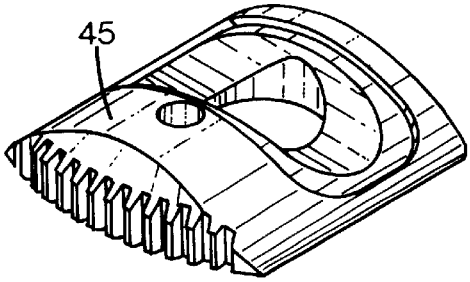
FIG. 9
FIG. 10
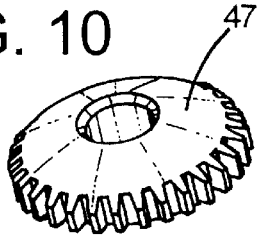
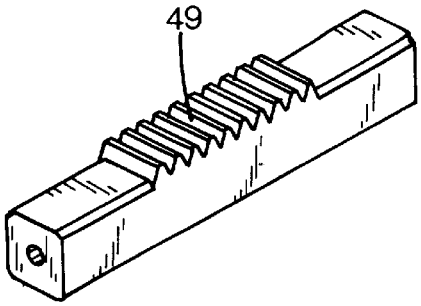
FIG. 11

PISTON MACHINE

TECHNICAL FIELD

The present invention relates to an axial piston machine that may be used as a hydraulic pump or hydraulic motor and includes a rotor having axial pistons and cylinders that are disposed in a ring wherein the pistons move back and forth relative to the cylinders when the rotor rotates.

BACKGROUND INFORMATION AND SUMMARY OF THE INVENTION

The most common type of such machines is tiltable disc machines. Many such machines are heavy and relative large. Conventional machines are also expensive and cumbersome to make. One object of the invention is to provide an axial piston machine that has smaller dimensions and lower weight and that can be produced at a lower cost than conventional axial piston machines.

This object is achieved by providing an inner part of the piston machine that has a spherical outer surface and an outer portion that has a corresponding spherical inner surface wherein grooves are defined in the spherical outer surface. Pistons are connected to the outer portion of the rotor and adjustment members are adapted to adjust the tilting angle of the inner part to set the operational volume of the present invention.

BRIEF DESCRIPTION OF THE DRAWINGS

The invention may be described with reference to the attached drawings.

FIG. 7 is a perspective cross-sectional view of the central element partially shown in FIG. 2;

FIG. 8 is a perspective view of the central element partially shown in FIG. 2;

FIG. 9 is a perspective view of a shoe that is partially shown in FIG. 2;

FIG. 10 is a perspective view of a cog wheel that is partially shown in FIG. 2; and FIG. 11 is a perspective view of a cog rod that is partially shown in FIG. 2.

DETAILED DESCRIPTION

Figure 1:
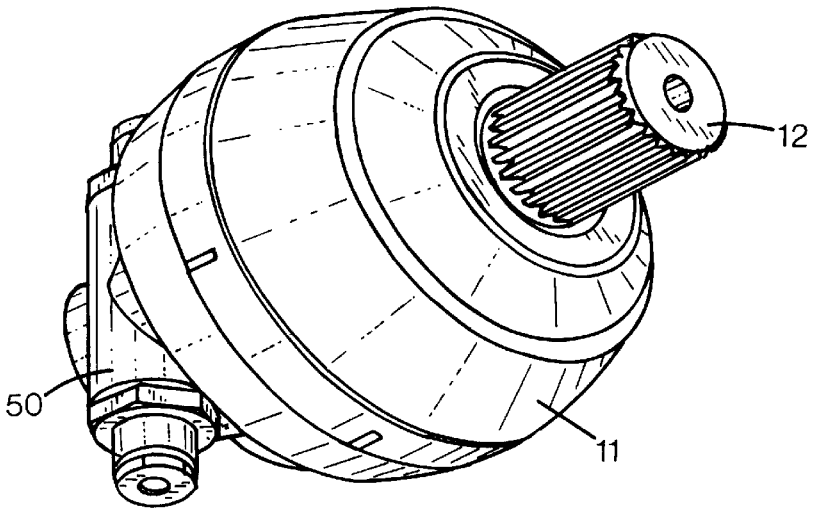
FIG. 1 is a perspective view of an axial piston machine according to the present invention.

With reference to FIGS. 1–11, the axial piston machine 10 has an outer housing 11 from which a driving axle 12 having protruding splines extends. The driving axle is integrated with an outer portion 13 that is rotatably disposed within a roll bearing 22. The outer portion 13 has an inner spherical surface 15 and an inner rotor 14 has a corresponding spherical outer surface 16 and the shape of these spherical surfaces are matching one another. The rotor outer portion 13 has two parts that may be screwed together by screws 24. A stationary central element 17 extends into the housing 11 from the other direction and it has bearing surfaces 18, 19 bearing against the outer portion 13. The central element 17 has a connection 20 for receiving high pressure oil and the housing 11 has a connection 21 for receiving low pressure oil. The inner rotor 14 is shown in a perspective view in FIG. 3 and a portion of the rotor 14 is shown in a sectional view in FIG. 4. The inner rotor 14 has a number of parallel grooves or openings 25 defined in its spherical outer surface 16 and the outer portion 13 of the rotor has a corresponding number of radial grooves or holes with a circular cylindrical liners 26 that rotatably receive the piston members 27. The grooves 25 form cavities to receive the pistons 28 (FIG. 5) that are guided by the piston members 27. To obtain a good seal, the grooves 25 have suitable sealants that seal against the spherical inner surface of the outer part 13 and absorbs any differences in play between the two spherical surfaces that may occur due to variations of the hydraulic pressure.

Figure 6:
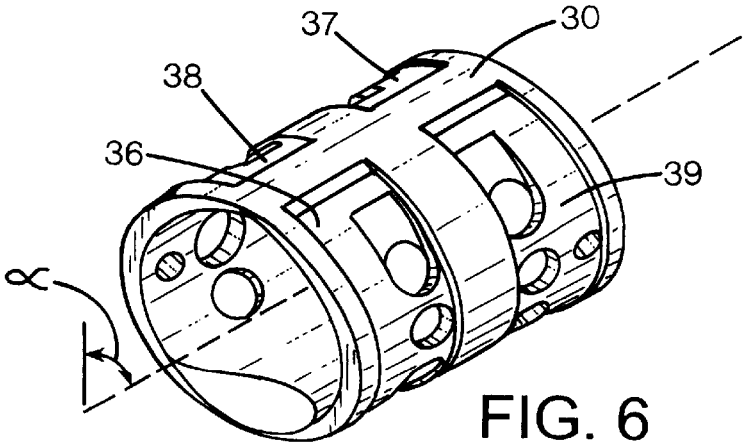
FIG. 6 is a perspective view of a sleeve shown in FIG. 2.

The inner rotor 14 is rotatably attached to a hollow sleeve 30 that is also shown in a perspective view in FIG. 6. The cylinder chambers 31, 32 (see FIG. 2) have on each side of the pistons 28 openings 33, 34 defined therein that are open towards the sleeve 30 and the sleeve has four cavity areas 36–39 of which the cavities 36, 37 are connected to a high pressure channel 42 disposed inside the central element 17 and the cavities 38, 39 are connected to the low pressure connection 21. All the cavities except the high-pressure channel 42 are in communication with the low pressure connector 21. When the rotor is rotating, the openings 33, 34 of the cylinder chambers 31, 32 are connected to high pressure and low pressure in an alternating fashion and the rotor is hydraulically balanced at all times.

Figure 2:
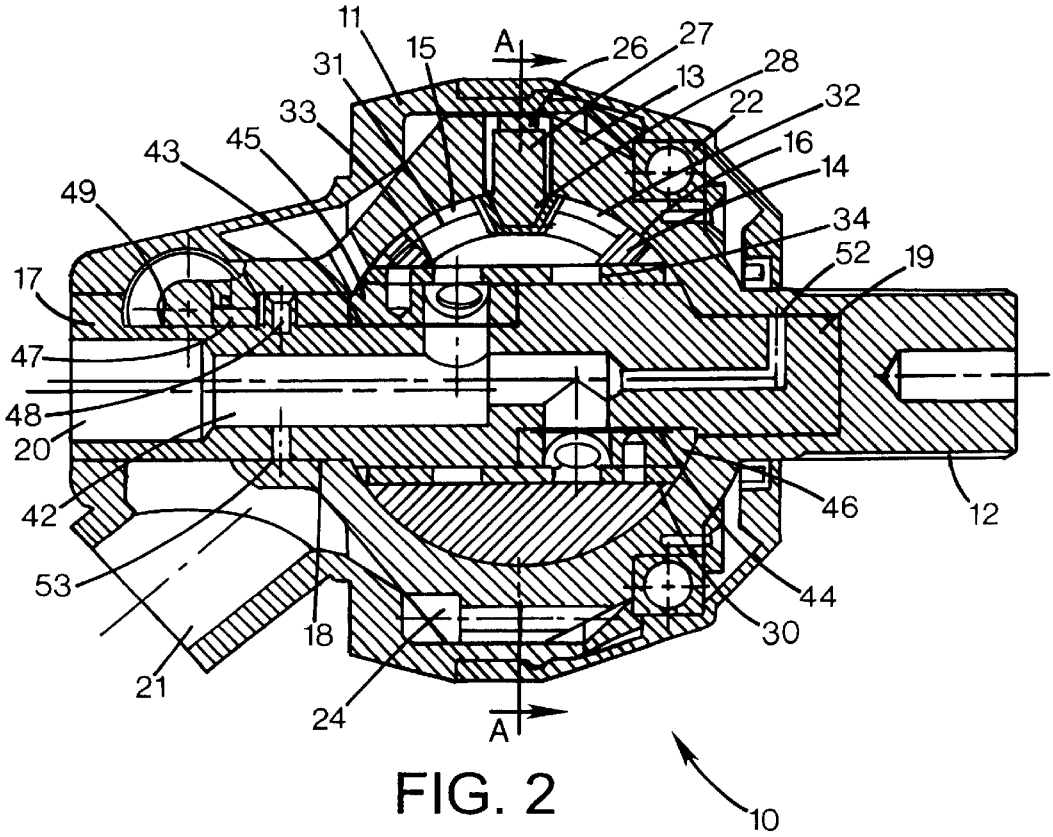
FIG. 2 is a cross-sectional view of the machine shown in FIG. 1.
Figure 3:
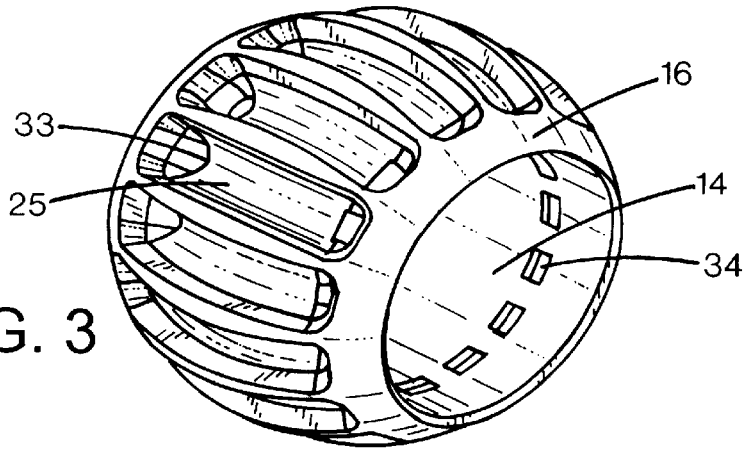
FIG. 3 is a perspective view of a rotor part shown in FIG. 2.
Figure 4:
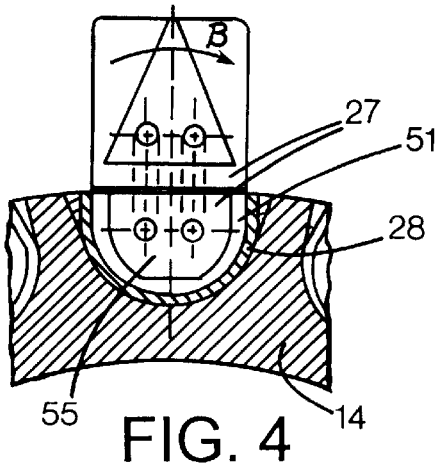
FIG. 4 is a sectional view of the rotor part shown in FIG. 3 and along line 4—4 of FIG. 2.
Figure 5:
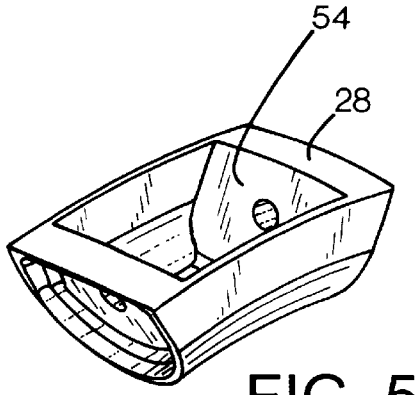
FIG. 5 is a perspective view of the piston that is shown in FIGS. 2 and 4.

As best shown in FIGS. 7 and 9, the central element 17 has two machined and chamfered plane surfaces 43, 44 and shoes 45, 46 slide on these surfaces. The shoes 45, 46 are preferably disposed inside the sleeve 30 and may be fastened with screws to the sleeve 30. The shoe 45 is preferably in engagement with a cog wheel 47. The cog wheel is rotatable about the member 48 on the central element 17 and this cog wheel is in operative engagement with a cog rod 49 that is driven by a hydraulically guided piston in a housing 50, as shown in FIG. 1. The adjustment mechanisms 45–50 may perpendicularly shift the shoe 45 against a plane of the paper in FIG. 2 and may thus rotate the sleeve 30, as shown by an angle alpha, so that the inner rotor 14 may rotate together with the outer portion and wobble inside the rotatable outer portion 13 when the rotor 14 is rotating. In this way, the pistons 28 may move back and forth inside the grooves 25 and the machine may be used as a pump or motor. The grooves may be set at a tilting angle beta relative to the rotation axis except for two positions per rotation to enable the pistons and the piston members to twist and turn to the angle beta. The piston members are rotatable inside the liners 26. The pistons may also move sideways and there should exist such a possibility of movement between the pistons 28 and the piston members 27. That is, the pistons should have sliding surfaces 54 and the piston members preferably has sliding surfaces 55 (see FIGS. 4 and 5) so that the piston 28, as shown in FIG. 2, may slide a millimeter or so relative to the piston member 27. This play 51 between the side of the piston and the piston member is shown in FIG. 4.

The bearing surfaces 18, 19 of the central element 17 have cavities 52, 53 that are in fluid communication with the high-pressure conduit 42. Preferably, they are connected via drill holes in the central element and the cavities hydraulically balance the rotational moment of the rotor that may occur in the plane of FIG. 2 when forces are transferred via the piston members 27 to the rotor outer part 13. Proper lubrication of the bearing surf aces are also ensured in this way.

In the axial piston machine shown, hydraulic forces may be symmetrically generated over the center of the sphere so that the forces are balanced out. The adjustment mechanism 45–50 may be subjected to small adjustment forces because the forces from the pistons are perpendicularly directed to the adjustment device's direction of movement and the friction forces are reduced hydraulically. The high-speed characteristics are advantageous because the parts are disposed close to the rotational center and symmetrically over the center of the sphere. The conduits for the hydraulic fluid are short and may be provided with a big area that may increase the efficiency and reduce the risk for cavitation when the machine is used as a pump. All these advantages enable the manufacturing of the machine of the present invention that has small dimensions and low weight and it can be manufactured at a low cost. The construction enables the use of plastic for many components instead of using metals. For example, the pistons may be made from plastics. The curved grooves 25 and the spherical and cylindrical inner surfaces of the rotor outer part 13 may be provided with plastic lining. This has the advantage that the high requirements of the surfaces of the sealing elements is less expensive and easier to satisfy and that the lining material may be replaced when they are worn out.

I claim:

1. An axial piston machine that is usable as a hydraulic pump and hydraulic motor, comprising:

a housing;

a rotatable rotor having an outer portion disposed inside the housing, the outer portion having a spherical inner surface;

an inner part having a spherical outer surface defining a plurality of grooves that are arranged in a ring shape, axial pistons disposed in the grooves, the pistons being movable back and forth along the grooves, the outer portion supporting the pistons; and an adjustment mechanism in operative engagement with the inner part for adjusting a tilt angle to set an operational volume of the piston machine.

2. The axial piston machine according to claim 1 wherein the cavities are elongate grooves defined in the outer surface of the inner part.

3. The axial piston machine according to claim 1 wherein each pistons defines a chamber on each side of the pistons, each chamber is adapted to alternatingly be in fluid connection with a high-pressure and a low-pressure portion of the axial piston machine.

4. The axial piston machine according to claim 3 wherein the piston machine further comprises piston members and a gap is defined between each piston member and piston, the inner part is disposed at an angle while the pistons are disposed in the cavities.

5. The axial piston machine according to claim 3 wherein the inner part bears against a sleeve member, the sleeve member has first openings in fluid communication with a high-pressure channel and second openings in fluid communication with a low-pressure channel.

6. The axial piston machine according to claim 5 wherein the sleeve member is rotatably attached to a central element, the sleeve member being rotatably relative to the rotor.

* * * * *